US006672856B1

(12) United States Patent
Khalifa et al.

(10) Patent No.: US 6,672,856 B1
(45) Date of Patent: Jan. 6, 2004

(54) DIFFUSER GUIDE VANES FOR HIGH-SPEED SCREW COMPRESSOR

(75) Inventors: H. Ezzat Khalifa, Manlius, NY (US); Michael K. Sahm, Avon, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/187,165

(22) Filed: Jun. 28, 2002

(51) Int. Cl.[7] ..... F04C 18/16; F01D 1/02
(52) U.S. Cl. ..... 418/201.1; 415/207; 415/211.2
(58) Field of Search ..... 418/181, 201.1; 415/207, 211.2, 224.5

(56) References Cited

U.S. PATENT DOCUMENTS 2,474,653 A * 6/1949 Boestad ..... 418/201.1
4,182,595 A * 1/1980 Burney et al. ..... 415/204
4,957,417 A * 9/1990 Tsuboi ..... 418/201.1
5,101,643 A * 4/1992 Hicke ..... 62/407

FOREIGN PATENT DOCUMENTS

| | | | | |
|---|---|---|---|---|
| DE | 0154840 | * | 4/1982 | ..... 418/201.1 |
| JP | 58-215693 | * | 12/1983 | ..... 418/201.1 |
| JP | 4-175488 | * | 6/1992 | ..... 418/201.1 |
| RU | 568746 | * | 8/1977 | ..... 418/201.1 |

* cited by examiner

*Primary Examiner*—John J. Vrablik
(74) *Attorney, Agent, or Firm*—Bachman & LaPointe

(57) ABSTRACT

A screw compressor includes a housing containing at least one rotor for generating a discharge flow in a discharge flow direction; a diffuser communicated with the housing and having a collecting portion for receiving the discharge flow, a diffuser throat and a diffuser portion, said diffuser extending from the housing in a diffuser direction; and at least one turning vane positioned in the collecting portion and adapted to guide flow from the discharge flow direction to the diffuser direction.

6 Claims, 2 Drawing Sheets

DIFFUSER GUIDE VANES FOR HIGH-SPEED SCREW COMPRESSOR

BACKGROUND OF THE INVENTION

The invention relates to screw compressors and, more particularly, to a screw compressor and diffuser structure wherein kinetic losses are reduced.

The compression process in a screw compressor occurs within rotating pockets. Kinetic energy is imparted to compressed gases. To reduce dissipative effects of leakage in these machines, and to reduce their size and cost, it is desirable to run them at high tip speeds. The optimum tip speed of these machines depends among other factors, upon the relative balance between leakage losses, which decrease at high speeds, and viscous and kinetic losses, which increase at high speed. In an oil-less or near oil-less machine, the viscous losses are of minor concern, and tip speed is limited by kinetic losses which increase with the square of speed. Higher tip speeds could be obtained in screw compressors if part of the leaving kinetic energy could be efficiently recovered in an exit diffuser. This is done, for example, with turbo-compressors wherein the discharge flow is much better directed by the blades and flow distortion is tolerable.

Screw compressors, on the other hand, have a much more complex flow at their discharge port(s), with unfavorable flow directions and, possibly, high circulatory structure. The complex geometry of the discharge port relative to the rotors and housing makes it much more difficult to guide the flow efficiently to a diffuser throat. This is in part due to the highly tangential components of flow discharged in opposite tangential or radial directions from the two or more meshed rotors of the compressor.

It is clear that the need remains for an improved structure for guiding discharge flows from the compressor so as to improve compressor efficiency.

It is therefore the primary object of the present invention to provide such a structure.

Other objects and advantages of the present invention will appear hereinbelow.

SUMMARY OF THE INVENTION

In accordance with the present invention, the foregoing objects and advantages have been readily attained.

According to the invention, a screw compressor is provided which comprises a housing containing at least one rotor for generating a discharge flow in a discharge flow direction; a diffuser communicated with said housing and having a collecting portion for receiving said discharge flow, a diffuser throat and a diffuser portion, said diffuser extending from said housing in a diffuser direction; and at least one turning vane positioned in said collecting portion and adapted to guide flow from said discharge flow direction to said diffuser direction.

BRIEF DESCRIPTION OF THE DRAWINGS

A detailed description of preferred embodiments of the present invention follows, with reference to the attached drawings, wherein.

DETAILED DESCRIPTION OF PREFERRED EMBODIMENT(S)

The present invention relates to a screw compressor with a diffuser structure for recovering kinetic energy within a discharge flow from the compressor so as to provide more efficient operation of same. The invention further relates to diffuser guide vanes for guiding of the flow from the compressor to the diffuser, thus reducing losses in kinetic energy in the flow.

Figure 1:
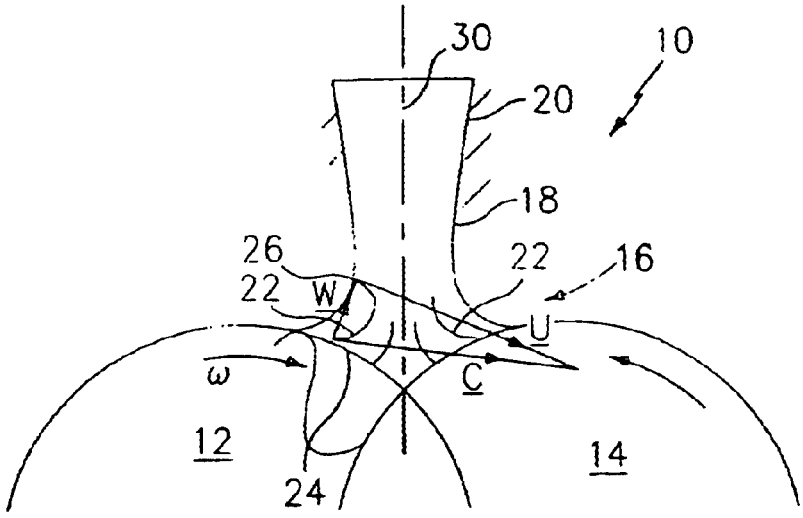
FIG. 1 schematically illustrates a radial diffuser with guide vanes in accordance with the present invention.

FIG. 1 shows a diffuser 10 radially oriented relative to two schematically illustrated rotors 12, 14 of a compressor, in this case a high-speed screw compressor. Diffuser 10 is provided as a housing or wall defining a flow passage having a collecting portion 16, a diffuser throat 18 and a diffusing portion 20. Rotors 12, 14 generate substantially tangential and radially directed pressurized discharge flows which are collected by diffuser 10 in collecting portion 16 and which flow through diffuser throat 18 to diffusing portion 20 wherein a portion of the kinetic energy is recovered as desired.

In accordance with the present invention, guide vanes 22 are advantageously provided and positioned within collecting portion 16 and leading to diffuser throat 18 so as to more smoothly guide the discharge flows from rotors 12, 14 into diffuser 10 as desired. Guide vanes 22 serve to reduce dissipative mixing and other kinetic energy losses which occur within collecting portion 16 as the substantially tangential and radially directed flows from rotors 12, 14 enter collecting portion 16.

Figure 2:
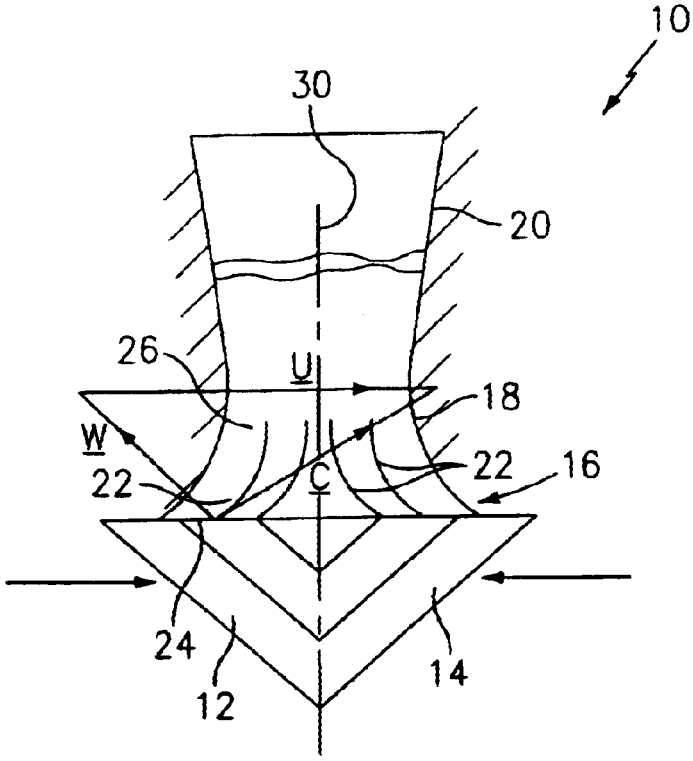
FIG. 2 schematically illustrates an axial diffuser with guide vanes in accordance with the present invention.

FIG. 1 illustrates an embodiment wherein diffuser 10 is mounted extending in a radial position. It should readily be appreciated that diffuser 10 can be positioned in an axial orientation or any orientation between radial and axial as well, and that guide vanes are equally desirable in such a configuration. The axial embodiment of the present invention is schematically illustrated in FIG. 2, and shows an axially oriented diffuser 10 extending axially relative to rotors 12, 14 and having guide vanes 22 positioned to smoothly guide flow from rotors 12, 14 into diffuser 10 as desired.

Figure 3:
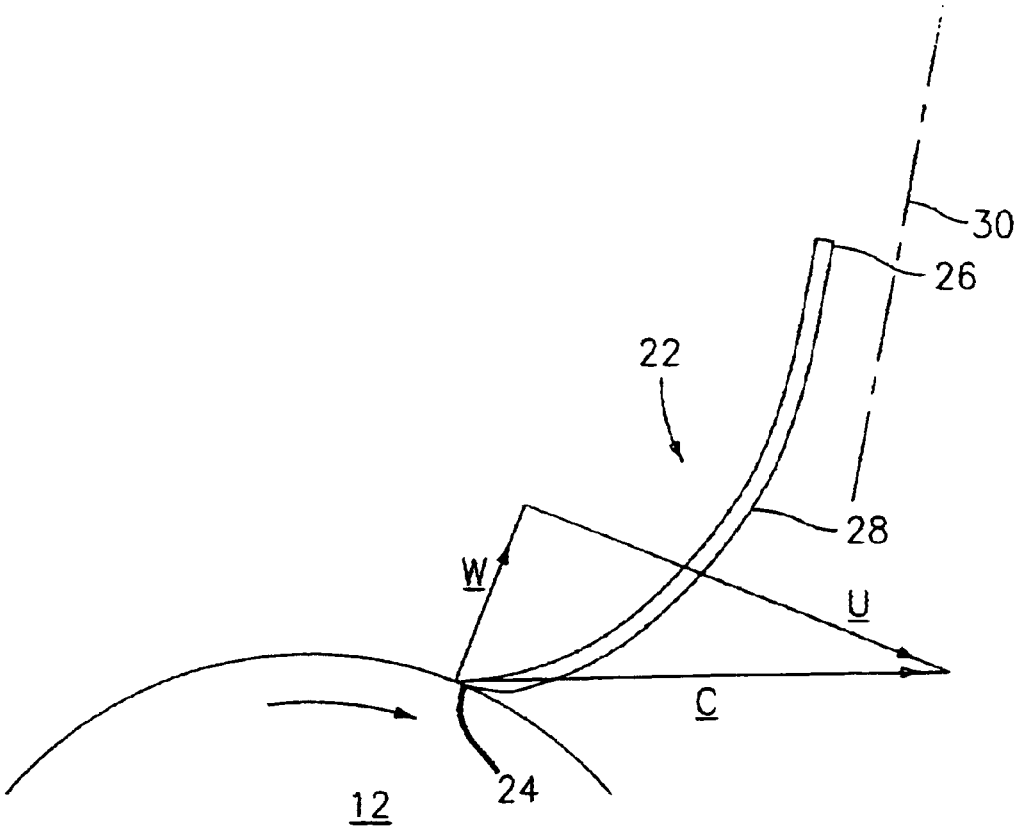
FIG. 3 further illustrates the guide vane structure in accordance with a preferred embodiment of the present invention.

Turning also to FIG. 3, a preferred configuration of guide vanes 22 in accordance with the present invention is illustrated.

Guide vanes 22 are preferably provided as substantially thin curved or arcuate members or vanes having a leading edge 24, a trailing edge 26 and a body portion 28 therebetween. In accordance with the present invention, it has been found that particularly advantageous positioning of leading edge 24 and trailing edge 26 can result in a further smoothing of flow from rotors 12, 14 into diffuser 10, thereby further reducing kinetic energy losses as desired.

Discharge flow from a rotor will have a velocity of gas relative to the rotor which can be represented by a vector W, and the rotor will have a peripheral velocity which can be represented by a vector U. These vectors provide for an absolute velocity of gas leaving the rotor which can be represented by the resultant vector C. It has been found to be particularly advantageous to provide guide vanes 22 having leading portion 24 arranged substantially tangential to the average leaving absolute velocity vector C, which advantageously provides for guiding of flow onto guide vanes 22 without any sudden turning.

It has also been found to be particularly advantageous to position trailing edges 26 of guide vanes 22 in an orientation which is substantially tangential to an axis 30 (FIG. 3) of diffuser 10. It should readily be appreciated, therefore, that body portion 28 as illustrated in FIGS. 1–3 is preferably a gradually curved member which curves or transitions from the desired positioning of leading edge 24 to the desired positioning of trailing edge 26.

It should be appreciated that the average vector as illustrated in FIG. 3 can change depending upon the tip speed of the compressor. Compressors do, however, have ratings and expected operating speeds, and the guide vanes 22 in accordance with the present invention are preferably positioned to have the desired tangential surfaces of leading and trailing edges 24, 26 based upon expected or rated operating speed of the compressor.

In accordance with the present invention, guide vanes 22 advantageously serve to smooth discharge flow from rotors 12, 14 into diffuser 10, thereby reducing kinetic energy losses and enhancing efficiency of compressor operation. This advantageously allows for higher tip speed operation of the compressor, which in turn allows for smaller compressors in general and thereby reduced cost and size of the equipment.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A screw compressor, comprising:

a housing containing at least one rotor for generating a discharge flow in a discharge flow direction;

a diffuser communicated with said housing and having a collecting portion for receiving said discharge flow, a diffuser throat and a diffuser portion, said diffuser extending from said housing in a diffuser direction; and at least one turning vane positioned in said collecting portion and adapted to guide flow from said discharge flow direction to said diffuser direction, wherein said discharge flow has an average leaving velocity vector and wherein said turning vane is an arcuate member having a leading edge, a tangent to said leading edge being substantially parallel to said average leaving velocity vector.

2. The apparatus of claim 1, wherein said turning vane has a trailing edge, wherein a tangent to said trailing edge is substantially parallel to an axis of said diffuser.

3. The apparatus of claim 1, wherein said diffuser direction is substantially radially oriented relative to said compressor.

4. The apparatus of claim 1, wherein said diffuser direction is substantially axially oriented relative to said compressor.

5. The apparatus of claim 1, wherein said discharge flow direction is non-parallel to said diffuser direction.

6. The apparatus of claim 1, wherein said discharge flow direction is a substantially radial direction.

* * * * *